US005666898A

United States Patent [19]

Bell

[11] Patent Number: 5,666,898

[45] Date of Patent: Sep. 16, 1997

[54] EQUIPMENT FOR RAISING SUNKEN VESSELS

[76] Inventor: Wesley K. Bell, Box 538, Manahawkin, N.J. 08050

[21] Appl. No.: 498,354

[22] Filed: Jul. 5, 1995

[51] Int. Cl.[6] ..... B63C 7/00

[52] U.S. Cl. ..... 114/54; 114/51; 414/137.1

[58] Field of Search ..... 414/137.1, 786; 114/50–55

[56] References Cited

U.S. PATENT DOCUMENTS

| | | | |
|---|---|---|---|
| 1,363,266 | 12/1920 | Petrie | 114/53 |
| 2,084,246 | 6/1937 | Diamantides | 114/53 |
| 2,829,615 | 4/1958 | Petrausky et al. | 114/53 |
| 3,030,905 | 4/1962 | Metzger | 114/55 |
| 3,500,785 | 3/1970 | Strange | 114/50 |
| 3,807,336 | 4/1974 | Briggs | 114/51 |
| 4,051,797 | 10/1977 | Hansmann | 114/51 |
| 4,448,569 | 5/1984 | Hackman et al. | 405/190 |
| 4,686,920 | 8/1987 | Thomas | 114/48 |

FOREIGN PATENT DOCUMENTS

| | | | |
|---|---|---|---|
| 112570 | 1/1918 | United Kingdom | 114/51 |

*Primary Examiner*—William E. Terrell
*Assistant Examiner*—Gregory A. Morse
*Attorney, Agent, or Firm*—Kenneth P. McKay

[57] ABSTRACT

Equipment for the raising, sunken vessels, specifically small to medium sized ships which are submerged in depths to which human descent for purposes of rigging retrieval gear to the ship is impractical or unsafe. The equipment can be employed remotely using video equipment for aligning the required underwater assemblies. The equipment involve lifting slings which are levered underneath the hull and then used to mechanically raise the vessel to the surface. It is particularly applicable to vessels which are resting on soft sand or clay ocean, sea, or lake bottoms, where interferences with the equipment as it is deployed underneath the vessel are a minimum.

4 Claims, 6 Drawing Sheets

EQUIPMENT FOR RAISING SUNKEN VESSELS

BACKGROUND OF THE INVENTION

1. Field of the Invention

The invention relates to a method and its associated equipment for raising sunken vessels, specifically small to medium sized ships which are submerged in depths to which human descent for purposes of rigging retrieval gear to the ship is impractical or unsafe. The method and equipment can be employed remotely. The equipment and method involve lifting slings which are levered underneath the hull and then used to mechanically raise the vessel to the surface. It is particularly applicable to vessels which are resting on soft sand or clay ocean, sea, or lake bottoms, where interferences with the equipment as it is deployed underneath the vessel are a minimum.

2. Description of the Related Art

The current art shows equipment, mechanisms, methods and processes for raising a sunken vessel which rely on a wide variety of mechanical and pneumatic means. This prior art includes machines for grappling hulls from the surface, mechanisms for remotely welding lifting mechanisms to the hull, mechanisms for filling sunken hull compartments with air bags, foam and other devices for buoyant re-floatation. In addition, the prior art shows a variety of methods for employing slings to lift vessels directly to the surface where those vessels are then refloated.

A major disadvantage of the prior art is that most of these methods and the equipment employed are complex and expensive to manufacture and use. This restricts the use to the refloatation of large hulls with very valuable cargos such that the salvage value exceeds the very high costs.

A secondary disadvantage is that many of these instruments of salvage are reliant on the use of divers to employ the rigging or other gear and, therefore, their application is inherently restricted to hulls which are submerged in shallow bodies of water. This is particularly true of devices which employ slings to lift the vessel.

PRIOR ART

U.S. Pat. No. 3,500,785 (STRANGE) discloses a system and method for salvaging submerged marine vessels by means of air fillable compartments or bladders attached to the vessel.

U.S. Pat. No. 3,807,336 (BRIGGS) discloses an apparatus for grappling a submerged vessel from the surface, allowing the vessel to be raised remotely by a lifting means.

U.S. Pat. No. 4,051,797 (HAUSMANN) discloses a system of components whereby explosive charges are used to connect lifting devices to a submerged hull, thereby allowing the hull to be raised.

U.S. Pat. No. 4,448,569 (HACKMAN, et al) discloses an apparatus which is employable by a remotely controlled system and includes a hollow tube and a guide having rollers through which the tube may be passed. The apparatus is used to bore lift slings beneath a sunken vessel to allow lifting of the ship.

U.S. Pat. No. 4,686,920 (THOMAS) discloses a boat lift device for raising vessels at a berth.

SUMMARY OF THE INVENTION

The objective of the present invention is to provide a method and the equipment for raising sunken vessels, specifically small to medium sized ships which are submerged in depths to which human descent for purposes of rigging retrieval gear to the ship is impractical or unsafe. This invention employs rigging gear and other equipment which can be assembled above the sunken hull, lowered into place, deployed around the vessel and operated from the surface to raise the hull.

The invention comprises three units: the surface lifting assembly, the submerged, aft located sub-assembly and the submerged forward located sub-assembly. The methods comprises the operation of the equipment during six phases: location of the submerged hull, the assembly and rigging phase, the submerging phase, the sling levering phase, the raising phase and the refloation phase.

The surface lifting assembly (hereinafter the "SLA") comprises a barge or other floating means, one large lifting mechanism such as a crane or winch, two smaller lifting mechanisms, remotely operable, underwater video television equipment, a control station, and a variety of rigging materials including block and tackle, steel cable, winches, brakes and other equipment items as necessary to support the application of this invention sub-assembly.

The submerged, aft located sub-assembly (hereinafter the "SASA") comprises a minimum of two large anchor blocks, rigged to the SLA for lowering into place by means of the SLA smaller lifting mechanisms. The two anchor blocks each have side-mounted block pulleys through which cables are rigged. These cables are connected on one end to the SLA smaller lifting mechanisms and on the opposing end to the several slings associated with the third sub-assembly. The pulleys are releasably connected to the anchor blocks such that the pulleys can be remotely disconnected from the blocks, freeing the sling-connected cables for raising to the surface.

The third sub-assembly, the submerged forward located sub-assembly (hereinafter the "FLSA") comprises a plurality of lifting slings, each constructed of reinforced material capable of lifting very heavy loads and with their lower, bottom facing sides reinforced with smooth steel plate, or other durable, corrosion-resistant wedge material. The slings are connected to the SASA as described above, and are also connected by cable to the lifting spreader web. This web encompasses an air-inflatable lifting bag and the web is connected to the large lifting mechanism located on the SLA by means of heavy steel cables.

The first phase of operation entails the location of the hull which is accomplished by means within the prior art, including sonar sounding, magnetic anomaly detection, television viewing, charting, etc.

The second phase of operation comprises the steps of assembling the SLA, SASA and FLSA sub-assemblies at the surface above the hull. This work is accomplished from the SLA barge or other floating means. This is followed by the third phase, the submerging phase, when the SLA is positioned directly above the submerged hull, the SASA is lowered to a position directly aft of the submerged hull, and the FLSA is lowered to a position directly forward of the submerged hull. The sub-assemblies are positioned using remotely-operated underwater television viewing equipment. They are then ready for the fourth phase of operations.

In this fourth phase, the anchor block connected cables are tensioned to draw the FLSA slings underneath the submerged hull. This is accomplished by the force of the cables wedging the steel-faced slings under the hull, across the surface of the ocean, sea or lake bottom. The slings are then in place for hull lifting. The remotely releasable pulley blocks are then released, allowing the sling cables to be operated.

The fifth phase of operations entails the inflation of the main lift air bag and initiation of the lift to the surface. The lift continues until the hull is at the surface. After the hull is at the surface, the sling air bags are inflated to further stabilize the hull and provide additional buoyancy for refloatation.

The sixth phase of operation entails the repair and dewatering of the hull so that it is refloated.

DETAILED DESCRIPTION OF THE PREFERRED EMBODIMENT

Figure 1:
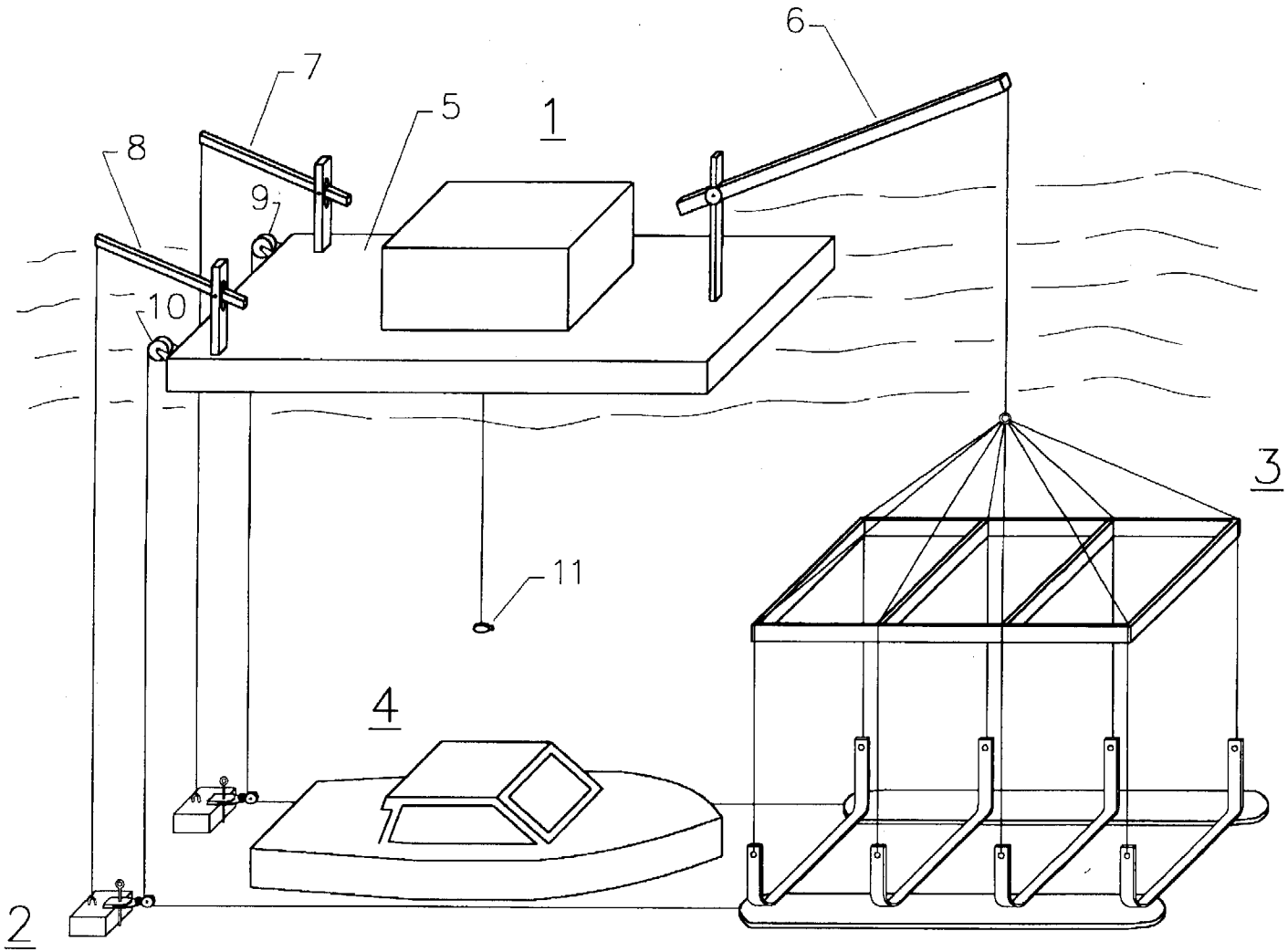
FIG. 1 shows the SLA, SASA, and FLSA in assembled condition and in their positions relative to the submerged ship hull. This condition is representative of the invention equipment and method of deployment at the end of phase 3 of operations.

FIG. 1 shows the surface lifting assembly (SLA) 1, submerged aft-located sub-assembly (SASA) 2, and the forward located sub-assembly (FLSA) 3 in assembled condition and in their positions relative to the submerged ship hull 4. This condition is representative of the invention equipment at the end of phase 3 of operations. Note the positions of the sub-assemblies 1, 2, and 3 relative to the submerged ship hull 4. This phase of operations follows phase 1, location of the submerged ship hull 4 and phase 2, assembly of the SLA 1, the SASA 2, and the FLSA 3 at the surface. During phase 4 of operation the FLSA 3 is deployed under and around the submerged ship hull 4. Phase 5 operations include inflation of the FLSA 3 and raising the FLSA 3 to the surface.

FIG. 1 also shows the details of equipment and its relative location on the SLA 1. The main platform for the SLA 1 is a large barge 5 or other floating means. Located on the forward end of the barge 5 is a large lifting mechanism 6, such as a crane, which is used to raise and lower the FLSA 3. Located on the aft end are two smaller lifting mechanisms 7 and 8 used to raise and lower the SASA 2. Also located on this end of barge 5 are two winching means 9 and 10 which are used to operate the SASA 2 while it is deployed to the submerged ship hull 4. The SLA 1 is equipped with underwater video equipment 11, various block and tackle, cables, air compressors, brakes, and other equipment commonly used in marine applications. Underwater video equipment 11 is used to remotely view all underwater operations associated with application of this invention.

Figure 2:
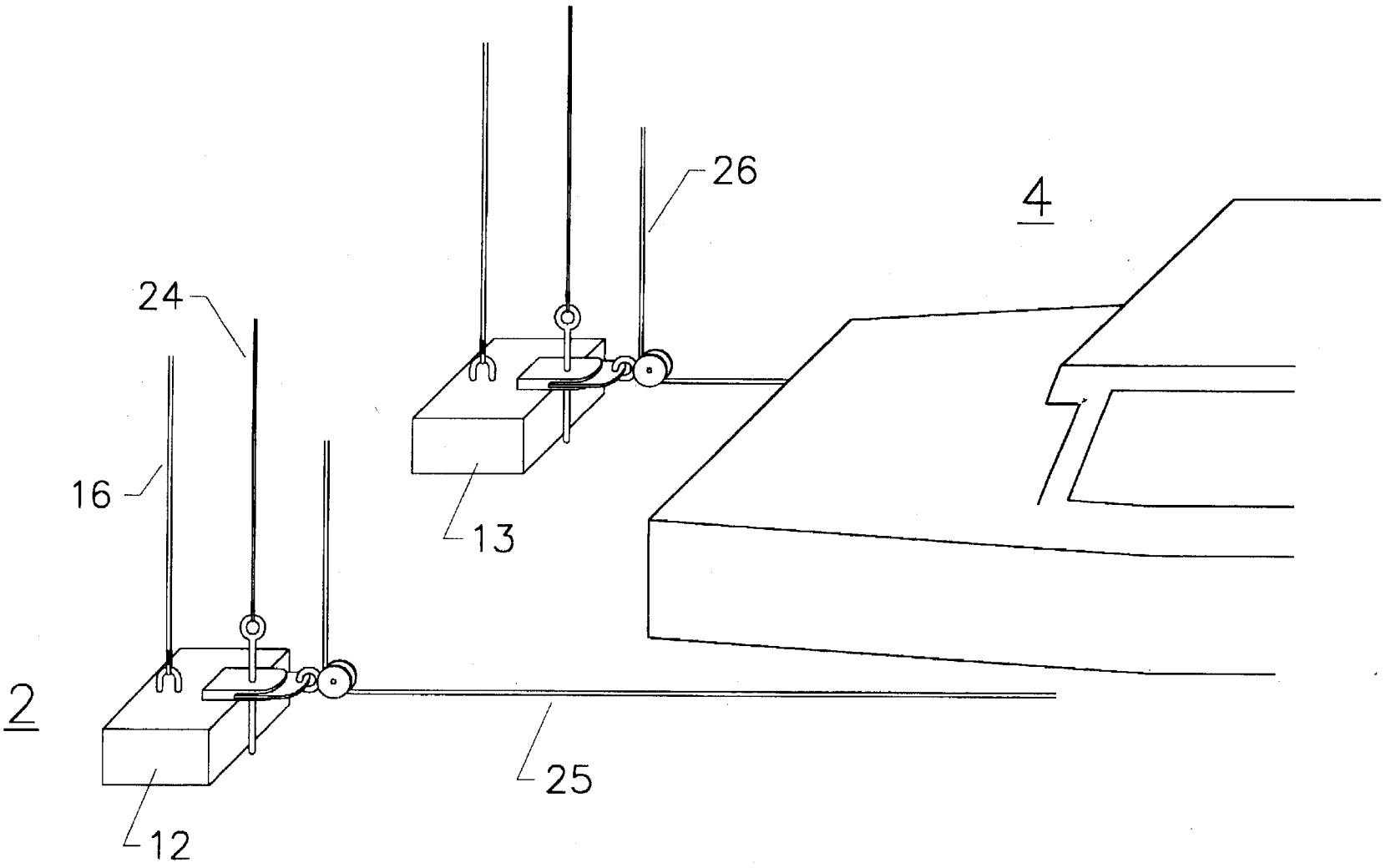
FIG. 2 shows the details of the SASA, located aft of the submerged ship hull, representative of the equipment at the end of phase 3 of operations.

FIG. 2 shows the details of the SASA 2, shown located submerged directly aft of the submerged ship hull 4, representative of the equipment at the end of phase 3 of operations. The SASA 2 comprises two large anchor blocks 12 and 13 and the necessary winching support mechanisms to deploy the FLSA 3 underneath the hull as described herein.

Figure 3:
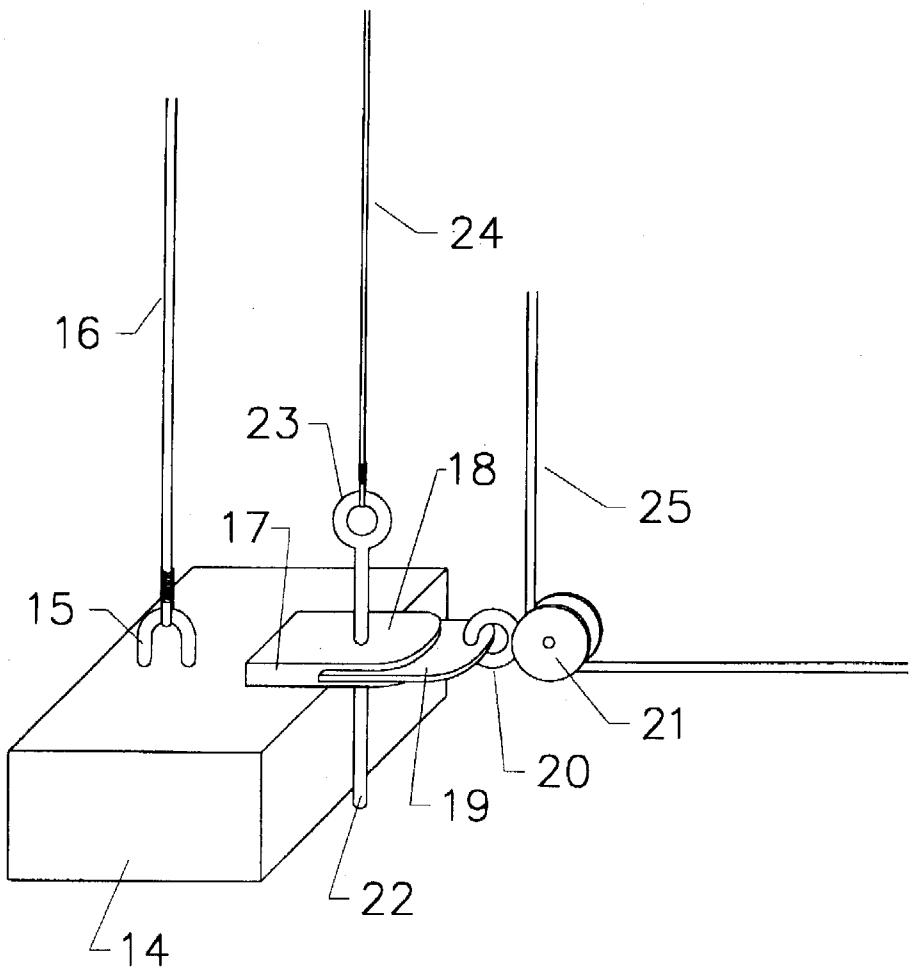
FIG. 3 shows the details of the SASA anchor block and releasable block pulley systems.

FIG. 3 shows the detail of the anchor block 12. The same configuration is applicable to anchor block 13. For simplification numerical designations are not assigned to block 13 items. Each anchor block is assembled from concrete, or other dense material, forming a cube 14. On the top surface is cast a lifting eye 15. Secured to the lifting eye 15 is a tensioning cable 16 which is operated by its respective smaller lifting mechanism 7 or 8 on the SLA 1. Fastened adjacent to the lifting eye 15 is a releasable block pulley 17. The releasable block pulley 17 is assembled from a split tongue 18, a flat sheave 19, a coupling ring 20, a pulley wheel 21 and a disconnect pin 22. The disconnect pin 12 has an eye 23 which connects to disconnect cable 24 which is operated from the SLA 1. Referring to FIG. 2, it can be seen that the SASA 2 is used to winch deploying cables 25 and 26, which are connected to winches 9 and 10 on the SLA 1. Referring to FIG. 2, operations are conducted as follows during phase 4: when the SASA 2 is readied, cables 25 and 26 are winched through their respective anchor blocks 12 and 13 drawing the FLSA 3 under the submerged hull 4. The disconnect pin 23 on each anchor block is then withdrawn by means of disconnect cable 24 on each anchor block, operated from SLA 1, allowing the pulley wheel 21 to freely deploy for the next phase of operation.

Figure 4:
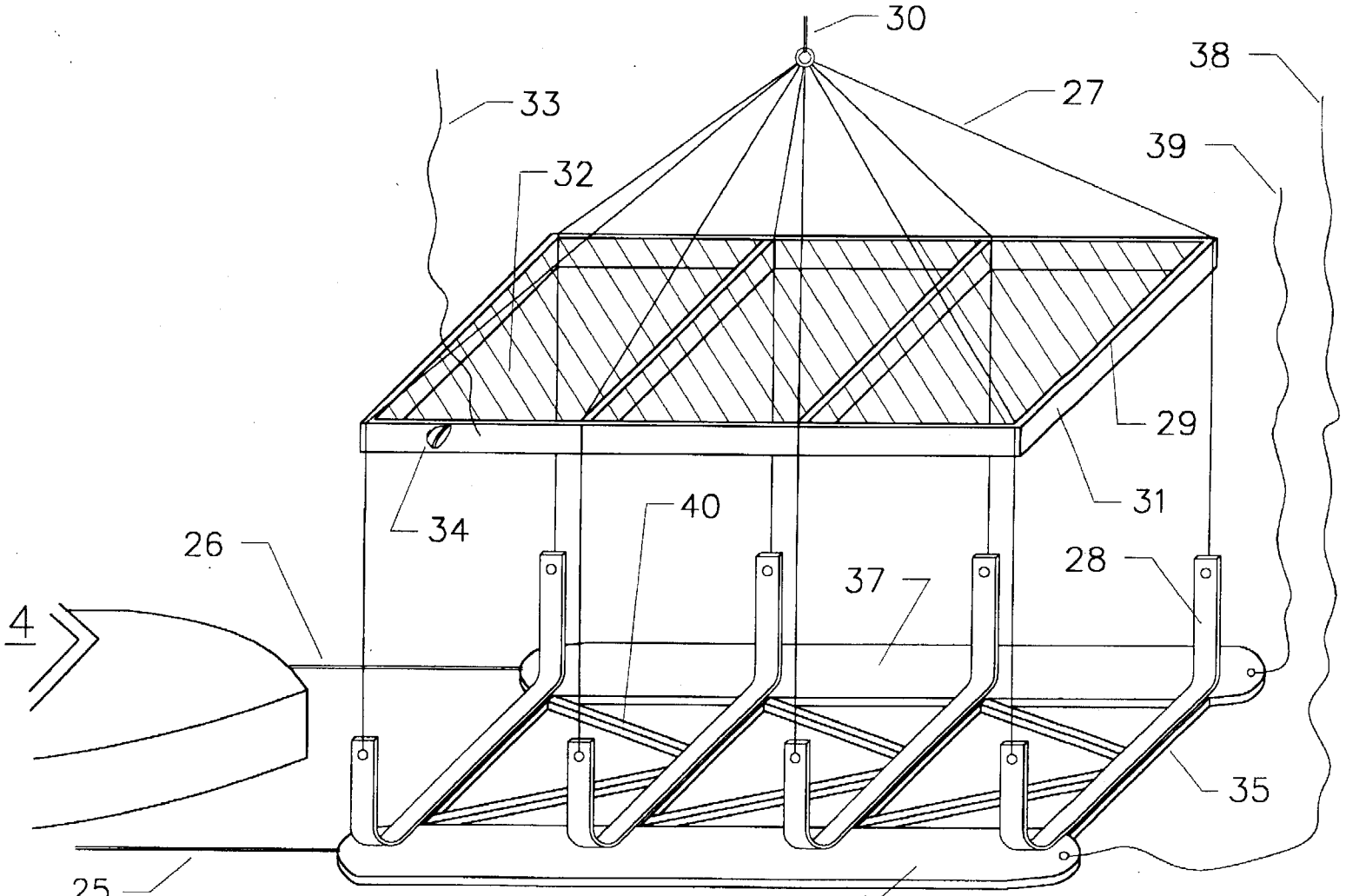
FIG. 4 shows the details of the FLSA, located submerged directly forward of the submerged ship hull, representative of the equipment at the end of phase 3 of operations.

FIG. 4 shows the details of the FLSA 3, located submerged directly forward of the submerged ship hull 4, representative of the equipment at the end of phase 3 of operations. The FLSA 3, during phase 4 of operations, will be deployed underneath the submerged ship hull 4 by means of winching cables 25 and 26, operated through their respective SASA anchor blocks 12 and 13 by winches 9 and 10 on the SLA 1. The FLSA 3 is assembled on the surface during phase 2 in the following manner. The FLSA 3 is comprised of a plurality of sling cables 27 which connect to respective ends of a plurality of slings 28 and are separated by means of spreader cage 29. Spreader cage 29 is a heavy rectangular frame which transfers the loads from each of the plurality of sling cables 27 to the main lift cable 30. Suspended beneath the spreader cage 29 is the main lift air bag 31 which is deflated until phase 4 of operations. The main lift air bag 31 is retained beneath spreader cage 29 by heavy wire mesh 32. Main lift air bag 31 is inflated from the SLA 1 through air hose 33. Lift air bag 31 has a pressure relief valve 34 installed such that, after inflation and as the main lift air bag 31 is raised to the surface, the excess pressure is automatically relieved to equalize lift air bag pressure to the desired set point. The plurality of slings 28 are connected by means of semi-rigid gridwork 35 designed to wedge and slide beneath the submerged ship hull 4 when the FLSA 3 is deployed during phase 4 of operations. Attached to the sides of the semi-rigid gridwork 35 are two stabilizing air bags 36 and 37 which are inflated when the FLSA 3 reaches the surface by means of hoses 38 and 39. Semi-rigid gridwork 35 has a lower smooth solid facing 40 made of flexible and durable wedging material.

Figure 5:
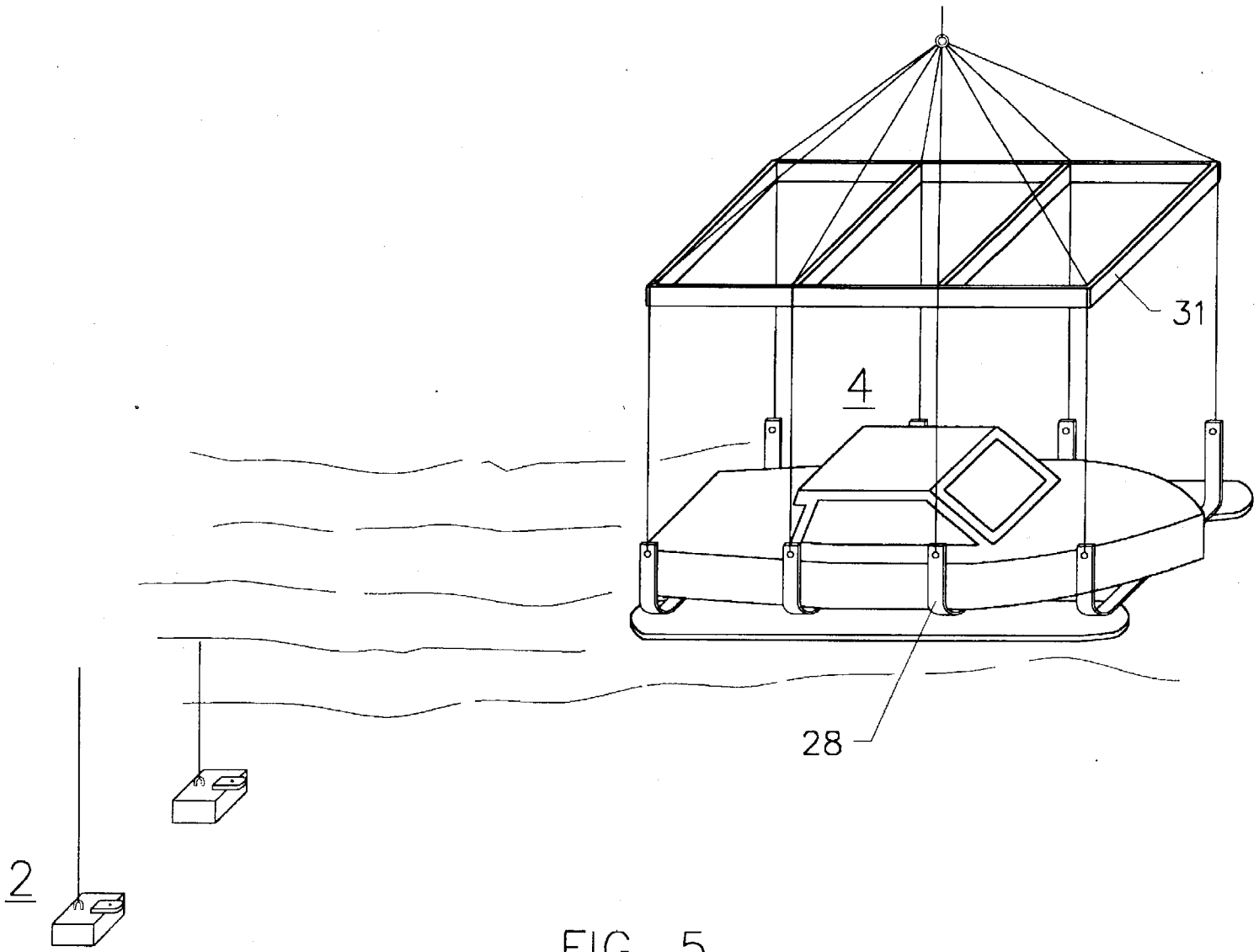
FIG. 5 shows the SASA after the fourth phase of operation. The slings have been winched beneath the submerged ship hull and the anchor block pulleys released. The main lift air bag has been inflated.

FIG. 5 shows the SASA after the fourth phase of operation. Each of the plurality of slings 28 has been winched beneath the submerged ship hull 4 and the anchor block releasable pulley blocks 17 released. The main lift air bag 31 has been inflated.

Figure 6:
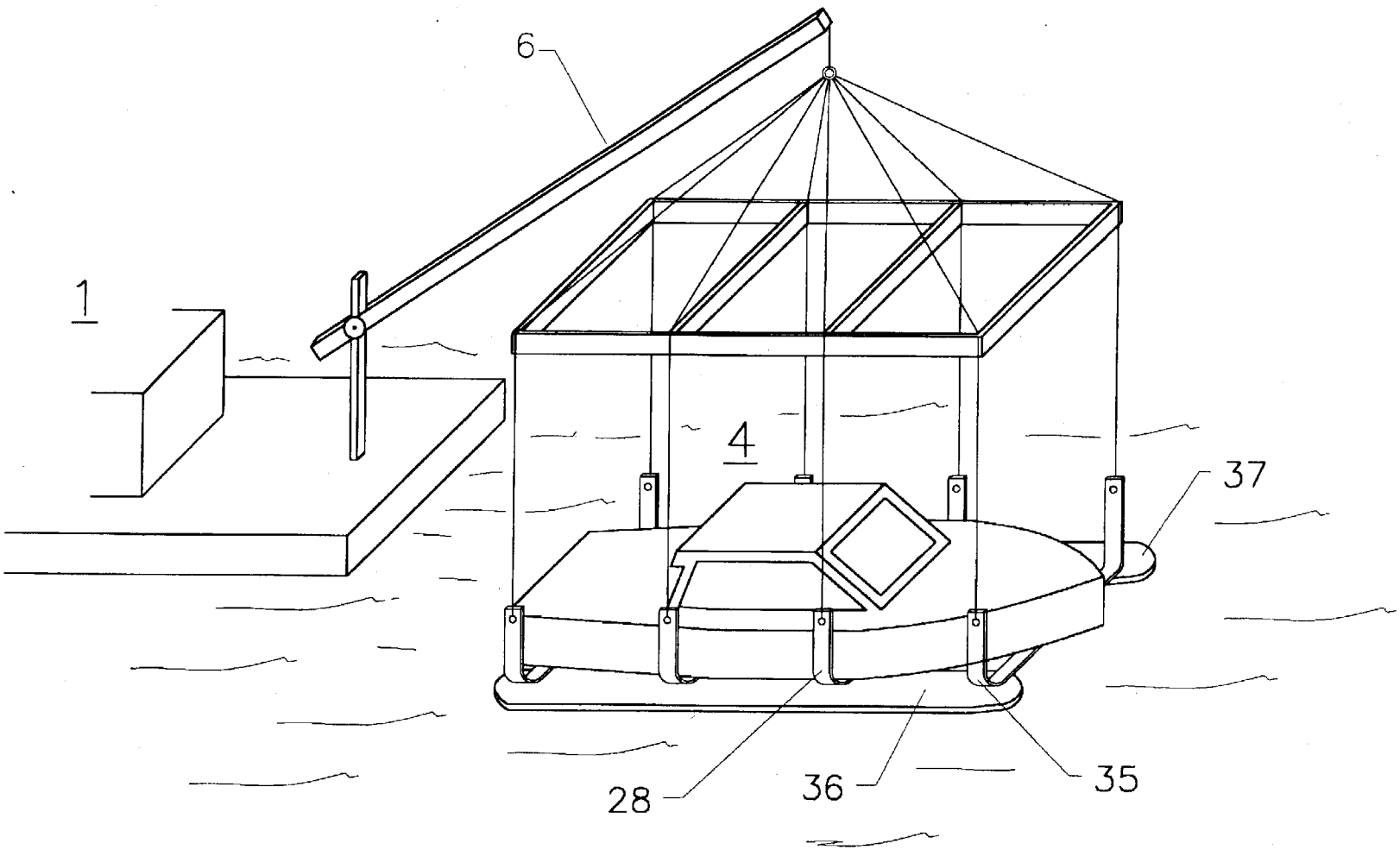
FIG. 6 shows the initiation of the fifth phase of operations. The submerged ship hull has been lifted to the surface, and the stabilizing air bags have been inflated.

FIG. 6 shows the fifth phase of operations. The submerged ship hull 4 has been lifted to the surface by means of the large lifting mechanism 6 on the SLA 1, and the stabilizing air bags 35 and 36 have been inflated.

What is claimed is:

1. An apparatus for raising a submerged ship hull from a depth of water for refloatation on a water surface, comprising:

a. a surface lifting assembly, comprising a floating means having a first end and a second end, having mounted on said first end a large lifting mechanism and on said second end two smaller lifting mechanisms and two winches, and having operable from thereon underwater video equipment;

b. a submerged, aft-located sub-assembly, comprising:

i. two large anchor blocks each of said large anchor blocks being made from a large cube of dense material having six faces, having fastened to an upper face a lifting eye, and having fastened to an adjacent face a side-mounted, releasable block pulley, each of said releasable block pulleys comprising:

(1) a rectangular, split tongue, said split tongue having a cavity therein, said cavity longitudinally extending throughout and having a hole through said split tongue, said hole perpendicularly bisecting said cavity in said split tongue;

(2) a rectangular, flat sheave having a hole perpendicular to said sheave longitudinal axis, and having a smaller hole parallel disposed through one end, said sheave disposed within said cavity of said split tongue, said hole in said sheave being aligned with said hole in said split tongue;

(3) a disconnect pin, having at one end an eye, said disconnect pin disposed through aligned holes in said sheave hole and said split tongue such that said eye is parallel aligned with said lifting eye on said anchor block;

(4) a pulley wheel;

(5) a coupling ring fastened to said pulley wheel and disposed within said hole in said end of said sheave; and, (6) a disconnect cable having a first end and a second end, said disconnect cable fastened at said first end to said eye in said disconnect pin, and fastened at said second end to said surface lifting assembly;

c. a submerged, forward-located sub-assembly, comprising:

i. a main life cable having a first end and a second end, said first end being fastened to said large lifting mechanism on said surface lifting assembly;

ii. a plurality of sling cables each having a first end and a second end, connected upon said main lift cable at a length from said second end of said main lift cable;

iii. a rectangular spreader cage suspended from said second end of said main lift cable, said spreader cage having a lining of heavy wire mesh, said spreader cage being disposed among and encompassed by said sling cables;

iv. an inflatable main lift air bag suspended from beneath said spreader cage among said plurality of sling cables, said main lift air bag being retained from upward floatation by said lining of heavy wire mesh and having a pressure relief valve settable to automatically relieve air pressure contained within at various settings and having an air hose connected to said main lift air bag whereby said main lift air bag is inflatable from said surface lifting assembly;

v. a plurality of slings numbering one half the number of sling cables, connected to pairs of said sling cables at said second ends of said sling cables such that each of said slings drapes ovally beneath said spreader cage, said slings being parallel aligned;

vi. a rectangular semi-rigid gridwork suspended from said slings and supporting said slings in aligned fashion, said semi-rigid gridwork having a smooth lower solid facing; and, vii. a pair of stabilizing air bags, straddling said semi-rigid gridwork outside said slings, each of said stabilizing air bags having an air hose connected whereby said stabilizing air bags are inflatable from said surface lifting assembly; and, d. a pair of winching cables each having a first end and a second end, said first end of said winching cable being fastened to said winching means on said surface lifting assembly, said winching cable disposed around said pulley wheel on said releasable block pulley on said submerged aft located assembly and having its second end connected to said semi-rigid gridwork.

2. An apparatus as claimed in claim 1, wherein said floating means comprises a barge.

3. An apparatus as claimed in claim 1, wherein said floating means comprises a ship.

4. An apparatus as claimed in claim 1, further comprising anchor blocks made from concrete.

* * * * *